US008502627B1

(12) United States Patent
Ahmad et al.

(10) Patent No.: US 8,502,627 B1
(45) Date of Patent: Aug. 6, 2013

(54) RELAY WITH STAIR-STRUCTURED POLE FACES

(71) Applicants: Ayham Ahmad, Kirkville, NY (US); Hassan B. Kadah, North Syracuse, NY (US); Andrew S. Kadah, Manlius, NY (US)

(72) Inventors: Ayham Ahmad, Kirkville, NY (US); Hassan B. Kadah, North Syracuse, NY (US); Andrew S. Kadah, Manlius, NY (US)

(73) Assignee: International Controls and Measurements Corporation, North Syracuse, NY (US)

( * ) Notice: Subject to any disclaimer, the term of this patent is extended or adjusted under 35 U.S.C. 154(b) by 0 days.

(21) Appl. No.: 13/622,466

(22) Filed: Sep. 19, 2012

(51) Int. Cl.
*H01H 51/22* (2006.01)
*H01H 3/60* (2006.01)

(52) U.S. Cl.
USPC ..... 335/80; 335/78; 335/193

(58) Field of Classification Search
USPC ..... 335/78, 80, 193
See application file for complete search history.

(56) References Cited

U.S. PATENT DOCUMENTS

| | | | | |
|---|---|---|---|---|
| 3,775,715 | A * | 11/1973 | Bosch et al. | 335/230 |
| 4,238,699 | A * | 12/1980 | Seilly | 310/27 |
| 5,155,458 | A * | 10/1992 | Gamble | 335/80 |
| 5,260,677 | A * | 11/1993 | Gamble | 335/78 |
| 5,548,259 | A * | 8/1996 | Ide et al. | 335/78 |
| 5,638,041 | A | 6/1997 | Beyer et al. | |
| 6,441,707 | B2 * | 8/2002 | Swartzentruber et al. | 335/78 |
| 6,737,946 | B2 * | 5/2004 | Seale et al. | 335/279 |
| 6,798,322 | B2 | 9/2004 | Copper et al. | |
| 6,827,331 | B1 | 12/2004 | Roos | |
| 7,626,288 | B2 * | 12/2009 | Protze | 335/209 |
| 7,750,772 | B2 * | 7/2010 | Hagen et al. | 335/279 |
| 7,932,795 | B2 | 4/2011 | Kozai et al. | |
| 8,212,636 | B2 * | 7/2012 | Fujimoto et al. | 335/78 |
| 2008/0136266 | A1 * | 6/2008 | Protze | 310/12 |
| 2010/0225428 | A1 * | 9/2010 | Fujimoto et al. | 335/189 |

* cited by examiner

*Primary Examiner* — Alexander Talpalatski
(74) *Attorney, Agent, or Firm* — Bernhard P. Molldrem, Jr.

(57) ABSTRACT

In an electromechanical relay the core of the relay coil and a corresponding zone of the armature are each provided with a pole face of zig-zag or stair-step configuration. A succession of corresponding edges of the core and armature pole faces concentrate the magnetic flux to increase the initial force on the armature and to limit the closing force as the armature reaches the closed position. The armature bearing is shaped to create a longitudinal wipe motion. The relay exhibits faster and quieter action with less bounce and reduced contact chatter.

14 Claims, 7 Drawing Sheets

RELAY WITH STAIR-STRUCTURED POLE FACES

BACKGROUND OF THE INVENTION

This invention relates to electromagnetic relays and contactors, and is more specifically related to the structure of an electromagnetic or electromechanical relay of the type that has a winding or coil that is energized to move an armature such that a load current may be applied to a load device. Relays and contactors may be considered as devices in which the appearance of a pilot current or voltage causes the opening or closing of a controlled switching device to apply or discontinue application of load current. The invention is particularly concerned with a the structure of the magnetic pole piece of the magnetic core of the winding, and the corresponding pole piece of the movable armature, structured in a way that manages the magnetic flux between core and armature as the armature closes so as to avoid noise, chatter, and wear, and to permit the relay to operate at smaller values of current for a given coil.

Electromagnetic or electromechanical relays or contactors are devices in which current that flows through an actuator coil closes or opens a pair (or multiple pairs) of electrical contacts. This may occur in a number of well-known ways, but usually a ferromagnetic armature is magnetically deflected towards the core of the coil to make (or break) the controlled circuit.

Electromagnetic or electromechanical relays are commonly used to control the application of power to a load, for example, to control the application power to a blower or fan in a ventilation, heating, or air conditioning system. These devices are inexpensive and in general have good reliability over a reasonable life span. However, due to the fact that the magnetic flux has to move across a gap that diminishes as the armature closes, the armature of the relay experiences a maximum force and acceleration at closure, which can result in a loud slapping noise, and can also produce bounce and chatter at the normally-open (NO) contact. The bounce or chatter may also produce RF switching noise, which may disturb electronic devices located near the relay.

A conventional relay is formed of a relay coil mounted on a yoke or frame of a ferromagnetic material. A core, i.e., a post formed of iron on which the coil is mounted, is affixed to the yoke, and a movable armature, also formed of ferromagnetic material, is mounted at an armature bearing, i.e., a hinge, to the yoke. The armature extends across the axis of the core of the coil, and a spring biases the armature away from the core so as to form a magnetic gap between the tip or magnetic pole face of the core and a facing surface on the armature. A conductive arm is supported on the armature and carries one or more movable contact members. In a typical relay, a normally-closed or NC movable contact is biased by the spring against a fixed normally-closed contact, and a normally-open or NO movable contact is biased by the spring away from a fixed normally-open contact.

In the conventional relay, the core pole face is a generally flat surface, and the facing portion of the armature is also a flat surface.

In order to actuate the relay, i.e., to close the normally-open contacts, current is supplied to the coil at sufficient amperage so that the magnetic force between the core pole face and the armature will overcome the spring force, and move the armature to a closed position against the core. At the initial open position, the gap is relatively large, but as the armature moves, the gap becomes smaller and smaller. For any given number of ampere-turns in the coil, the magnetic force felt by the armature will be in proportion to the inverse cube of the gap distance or separation between the armature and the core pole face. Consequently, a relatively large current is initially required to overcome the spring force and start the closure motion of the relay armature. Then at that same current, the force on the armature increases sharply as the gap distance diminishes. This results in a large acceleration just as the armature reaches the pole face of the core. The sudden collision of the armature with the core can cause the armature to bounce off, and can also cause the normally-open contacts to open and close intermittently, creating chatter and also producing arcing and RF switching noise. In addition, the relay closure can be audible, and present unpleasant clicking noises to persons present in the vicinity.

To date, no one has come up with any effective way to limit or control the magnetic forces involved with relay actuation, and no one has effectively reduced relay noise, chatter, or RF switching noise. It has been previously proposed, e.g., in Kozai et al. U.S. Pat. No. 7,932,795 and in Copper et al. U.S. Pat. No. 6,798,322 to place a cushion, pad or bump between the core pole face and the armature as a way of cushioning the closure of the armature so as to avoid audible or acoustic relay noise. However, these arrangements add to the complexity of the coil, do not level out the magnetic force on the armature, and have limited success at reducing chatter and electrical switching noise.

OBJECTS AND SUMMARY OF THE INVENTION

Accordingly, it is an object of the present invention to provide an improvement to a relay or contactor that overcomes the above-mentioned drawback(s) of the prior art.

It is a more particular object to provide an improved structure for a relay to achieve faster and quieter operation, and improved dynamics of the stroke of the armature, while employing bobbin, coil, spring, yoke and contacts that are the same or similar to those used in similar existing relays.

It is another object to provide a relay with improved geometry of the core pole face and the mating pole face of the armature to manage the magnetic flux so that initial magnetic force is increased over the conventional design at the commencement of actuation, and is reduced in respect to that of relays of conventional design at closure, so as to avoid acoustical noise, bounce, chatter, and electrical switching noise.

According to an aspect of this invention, an electromechanical relay is formed of a yoke of a ferromagnetic material, with a relay coil mounted on the yoke, and with the ferromagnetic core being affixed onto the yoke. The core protrudes through an axis of the relay coil. An armature formed of a ferromagnetic material has an armature bearing at a proximal end hinged onto the yoke. The armature extends across the axis of the core. The armature is arranged so that it is pulled in to a closed position against the core when the coil is energized. A return spring is mounted on the yoke and on the armature, and biases the armature so as to pull it to an open position when the coil is de-energized. A movable contact is mechanically carried on the armature to move between open and closed positions. A fixed contact positioned to close electrically with the movable contact when the latter is in one of its open and closed positions. The relay of this invention is improved in that the core pole face, at an axial end of the magnetic core, takes the form of a series of stepped substantially flat strips that extend generally in respective planes and successive ones of which are joined by riser surfaces that extend up or axially from the plane to the plane of the next such strip. The armature includes a corresponding armature pole face in the form of a corresponding series of stepped substantially flat strips and riser surfaces. The corresponding steps or strips of the core pole face and the armature pole face focus the magnetic flux as the edges of the stepped flat strips as the strips pass one another during closure, so that there is an initial increased magnetic force that is kept at a value to close the relay quietly, without the objectionable noise, bounce or chatter.

In a favorable embodiment, a first step of the armature pole face is positioned laterally beyond the core pole face in the direction towards the armature bearing. In the preferred embodiment, the axial height of the stepped flat strips of the core pole face increases in the direction away from the armature bearing. The armature pole face may have a flat strip that protrudes axially below an end of the core pole face on the direction towards the armature bearing. The return spring may be a leaf spring of omega profile having one leg affixed to the armature and another leg affixed to the yoke, with a generally arcuate portion arching over the armature bearing. The armature bearing may have a pair of transverse hinge members extending laterally from a proximal end of the armature. Favorably the yoke may have a pair of hinge posts, such that the hinge members fit against the hinge posts of the yoke to form the armature bearing. The hinge members have an arcuate or radiused surface facing against the respective hinge posts, such that as the armature closes it also travels longitudinally to create a wipe motion. This motion allows the corners or edges of the core pole face and of the armature pole face to be more or less aligned to focus the magnetic flux, but to keep the riser surface from colliding with each other when the armature is drawn to its closed position.

In the relay of this invention the yoke may be formed of a ferromagnetic material, with a relay coil mounted on the yoke and a ferromagnetic core affixed onto the yoke and protruding through the axis of the coil. An armature formed of a ferromagnetic material has an armature bearing formed at one end and is hinged onto the yoke, with the armature extending across the axis of the core, and arranged so to be pulled in to a closed position against the core when the coil is energized. A return spring is mounted onto the yoke and the armature and is biased to pull the armature to an open position when the coil is de-energized. One or more movable contacts may be mechanically carried on the armature to move between open and closed positions, with at least one fixed contact being positioned to close electrically with the movable contact when the latter is in one of its open and closed positions. In the relay of this invention, the core and the armature have corresponding respective pole faces with mating zig-zag profiles, considered in the longitudinal direction of the armature, i.e., transverse to the axis of the armature bearing. These zig-zag profiled pole faces define stepped successive transverse and axial surfaces that meet at corners. The magnetic flux between the core pole face and armature pole face is concentrated at successive corners of the mating zig-zag profiles as the armature moves from its open position to its closed position.

Favorably, the armature is in the form of a plate of a ferromagnetic metal having a proximal end at which are formed transverse hinge members that fit against hinge posts of the yoke to form the armature bearing. A series of steps that extend transversely across the armature plate constitute the armature pole face. Corresponding with the series of steps, the armature is of progressively reduced thickness from proximal to the distal, and the steps have radiused edges or corners.

Favorably also, the hinge members that form the armature bearing have an arcuate surface facing the respective hinge posts, so that as the armature closes it also travels laterally to create a wipe motion. This motion also moves the armature pole face in the proximal direction so that the vertical surface of the structured pole faces do not touch one another as the armature closes.

In any electro-mechanical relay or contactor, the magnetic force field exists in the air gap between the armature pole and the core pole. The field strength is proportional to the area of the poles at the gap, and decreases rapidly as the air gap increases. The structure of the armature and core pole faces is such as to "trick" the air gap. This occurs because over the full distance or stroke of the armature, the stair-step configuration of the pole faces provides a number of different points where the air gap is smaller than the distance that the armature has to travel to closure. In the embodiment described below, there are four such points where the corners or edges of the stair-steps face each other to focus the magnetic flux. The strongest flux is generated at the edges of the steps, because there is a smaller air gap there between the armature and core pole faces. This focused flux increases the total force applied on the armature at the initial, or open position, for a given number of ampere-turns. This stronger force will break the normally-closed contact as the armature engages in an earlier movement as compared with a standard design relay. This means there is more acceleration at the time when current first starts flowing in the relay coil, causing the relay to have a faster closing time. We have found the actual closing time of the relay of this inventive design to be twice as fast as a conventional relay that has the same coil and same gap length or stroke. Viewed in another way, this also means that the relay will function well with a reduced actuation current. Alternatively, the relay coil can be made with a smaller number of turns, or with finer wire for the same performance as with the existing relay, but requiring less copper.

The above and many other objects, features, and advantages of the improved relay (or contactor) of his invention will become apparent from the ensuing detailed description of a preferred embodiment, considered in connection with the accompanying Drawing.

DETAILED DESCRIPTION OF A PREFERRED EMBODIMENT

Figure 1:
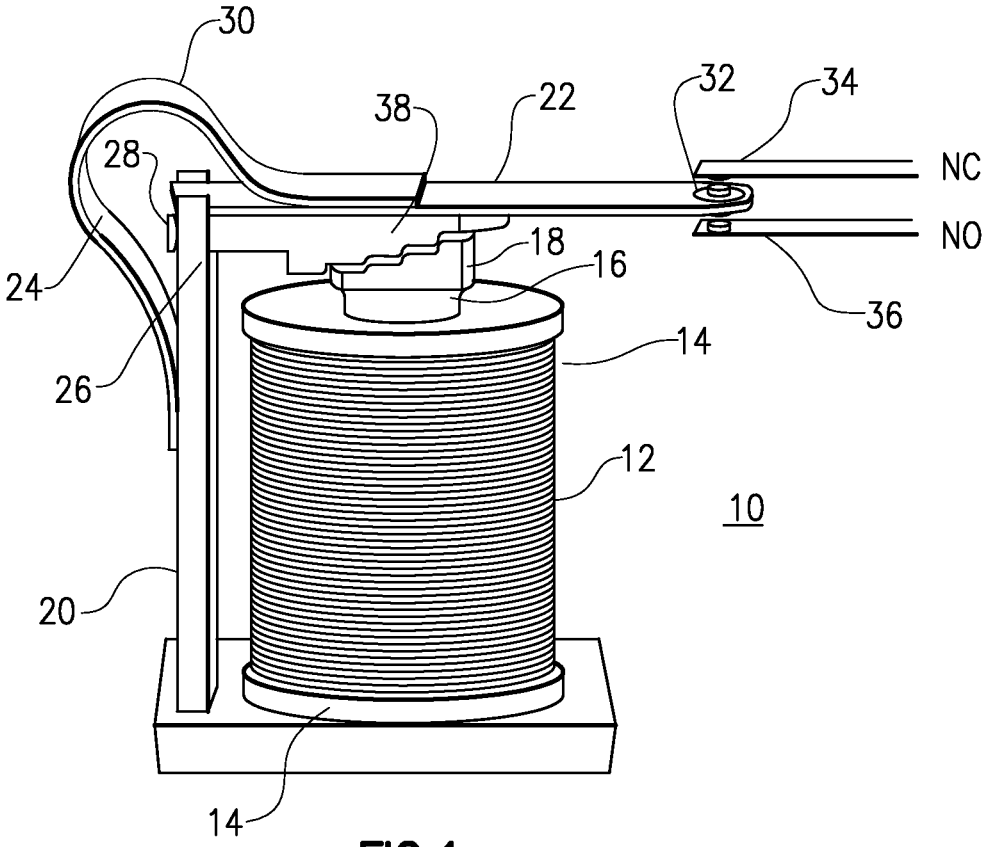
FIG. 1 is a perspective view of a relay according to one possible embodiment of the present invention.
Figure 2:
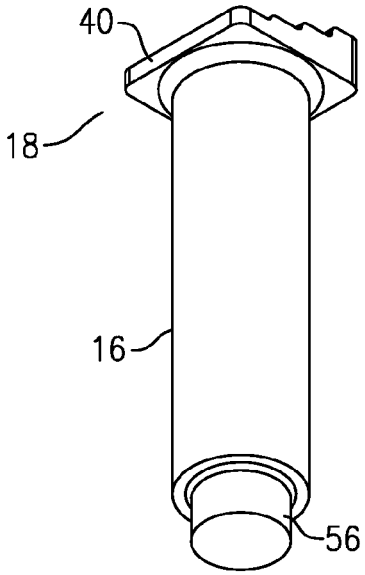
FIGS. 2 and 3 are perspective views of the core employed in this embodiment, featuring a stair-step core pole face.
Figure 3:
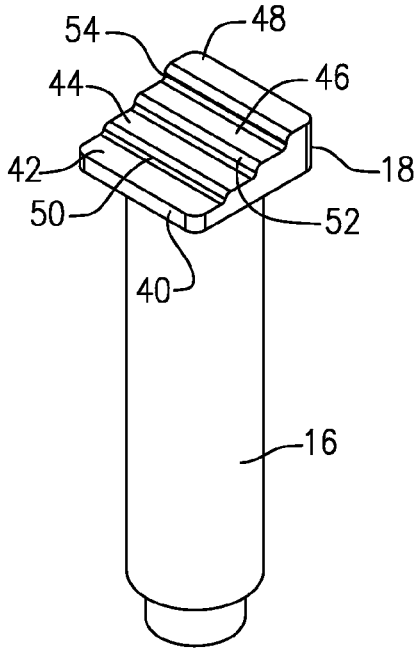
Figure 4:
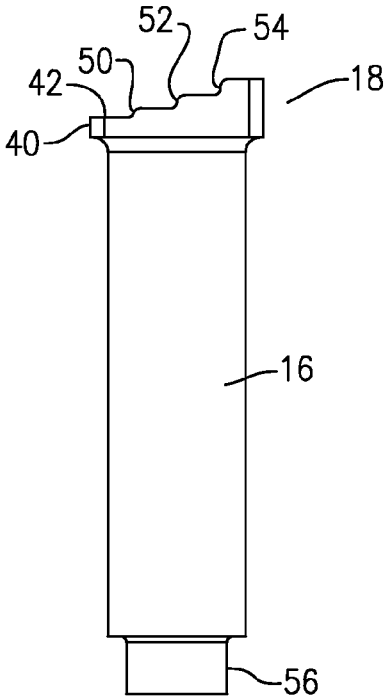
FIG. 4 is a side elevation thereof.
Figure 5:
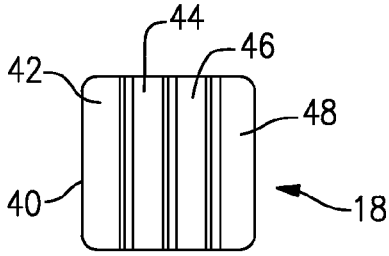
FIG. 5 is a top plan thereof.
Figure 6:
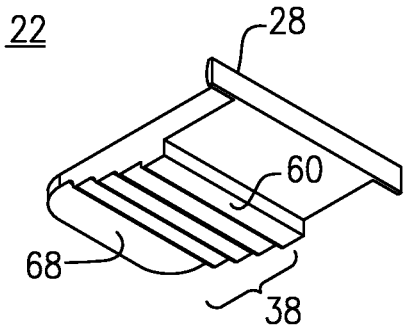
FIGS. 6 and 7 are perspective views of the armature employed in this embodiment.
Figure 7:
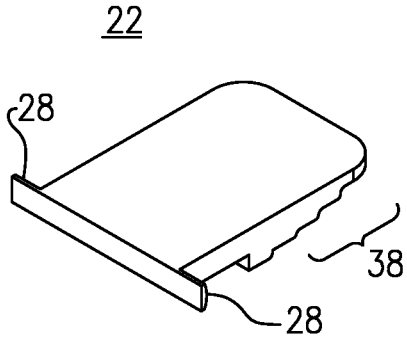
Figure 8:
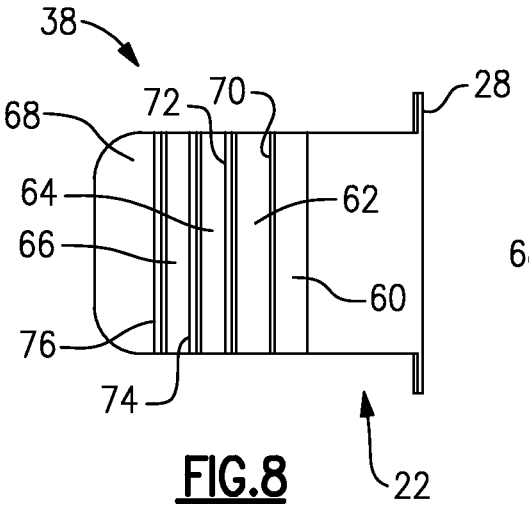
FIG. 8 is a bottom plan view thereof.
Figure 9:
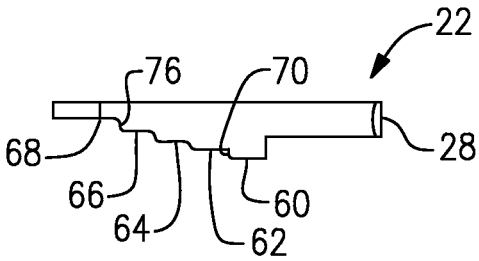
FIG. 9 is a side elevation thereof.

With reference to the Drawing, and initially to FIG. 1 thereof, a single-pole double-throw relay 10 here is shown to have a relay coil 12 wound on a bobbin 14 with a ferromagnetic core 16, i.e., an iron rod, at the axis of the bobbin. One end of the core protrudes through the coil 10, and is formed as a core pole face 18. A frame or yoke 20, also formed of a ferromagnetic metal, serves as a mount onto which the other end of the core 16 is secured. The yoke also extends parallel to the axis of the coil 12. An armature 22, i.e., a hinged ferromagnetic plate, is mounted at an upper end of the yoke 20 and an armature bearing 24 or hinge is formed there, defining a proximal end of the armature 22. The armature bearing is formed of a pair of posts 26 that extend in the axial direction at the upper end of the yoke 20, and a pair of transverse hinge members 28 or arms formed on the proximal end of the armature 22. These hinge members 28 have arcuate, i.e., radiused faces that contact the hinge posts 26, which serves to create a transverse motion or wipe when the armature 22 opens and closes.

A spring 30, here in the form of an omega-shaped leaf spring, is affixed onto the yoke 20 and onto the outer surface of the armature 22, and has an arcuate center portion that arches over the armature bearing 24. The spring 30 urges the armature 22 upwards, or axially away from the coil 12. In other possible embodiments, the spring can take on other forms.

As also shown, a movable contact 32 (or contacts) is supported on the distal end of the armature 22, and faces a normally closed contact 34 and a normally open contact 36, at the beginning and end of the armature stroke positions, respectively.

In the relay 10 of the present invention, the pole face 18 of the relay coil core 16 and a corresponding relay face 38 of the armature 22 have mutually interacting stair-step or zig-zag configurations, which increases the initial closing force on actuation, and moderates the closing force as the gap width decreases.

The shape and configuration of the magnetic core 16 of this embodiment can be explained by consideration of FIGS. 2, 3, 4 and 5. The core 16 is configured as a ferromagnetic post, with the core pole face 18 of stair-step configuration at its upper end. The pole face 18 has a proximal edge 40 that is in a vertical plane, i.e., parallel to the core axis, and transverse to the proximal-distal direction. A series of first to fourth stair-tread strips or surfaces 42, 44, 46, 48 are each at a successive different level considered along the axis of the core, and there are vertical riser surfaces 50, 52, and 54 that respectively join the stair-tread surfaces 42 to 44, 44 to 46 and 46 to 48. These create edges or corners, which may favorably be radiused or rounded. There are four edges formed in this embodiment but depending on the requirements for the relay, there could be more or fewer for a given relay application. At the lower end of the core 16 is a smaller diameter portion 56 that is intended to fit into a corresponding opening or socket at the base of the yoke 20.

The stair-step configuration of the pole face 38 of the armature 22 of this embodiment is illustrated in FIGS. 6 to 9. The armature 22 has the pole face 38 formed on its under side, i.e., the side that faces towards the core pole face. Here are formed first to fourth horizontal strips or stair-step tread members 60, 62, 64, and 66, in succession in the proximal to distal direction. A corresponding first to fourth vertical riser surfaces 70, 72, 74 and 76 extend in planes that are parallel to the core axis (considered when the armature is closed against the core) and transverse to the proximal-distal line of the armature. These riser surface 70, 72, and 74 respectively join the stair-tread surfaces 60 and 62, 62 and 64, and 64 and 66. The fourth riser surface 76 joins the stair-tread surface 66 with the under surface 68 of the armature 22. The armature pole face 38 thus has a series of first to fourth transverse edges that mate with the corresponding edges of the core pole face 18 as the armature 22 is drawn from its open of full-gap position to its closed position. As shall be discussed shortly, this creates a flux-concentrating effect between successive pairs of edges on the core pole face and armature pole face, so that there is an improved initial magnetic force and a more controlled or reduced magnetic force when the armature reaches its closed position.

Also shown in FIGS. 6 to 9 are the transversely extending hinge members 28 which have rounded i.e., cylindrical surfaces on the sides that face against the yoke posts 26. This structure causes the closing motion of the armature 22 to have a measure of linear or wipe motion along the proximal-distal line of the armature. This has functions of avoiding welding of the contacts and also assists in line-up of opposing edges of the armature and core pole faces, as will be discussed shortly.

Figure 10A:
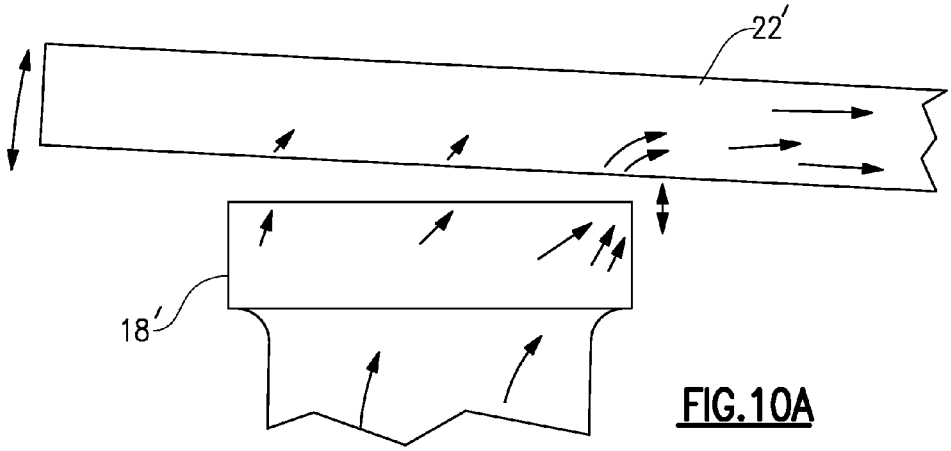
FIG. 10A is a schematic magnetic flux diagram for explaining the action of the core and armature of a corresponding relay of the prior art.

The magnetic flux-focusing or flux-concentrating effect in the relay of this invention can be explained with reference to FIGS. 10A, which shows the magnetic flux between core and armature in a typical relay of the prior art, and 10B, which shows the magnetic flux between the core and armature in a relay embodying this invention. Both of these are shown at the open or full-gap position.

Figure 10B:
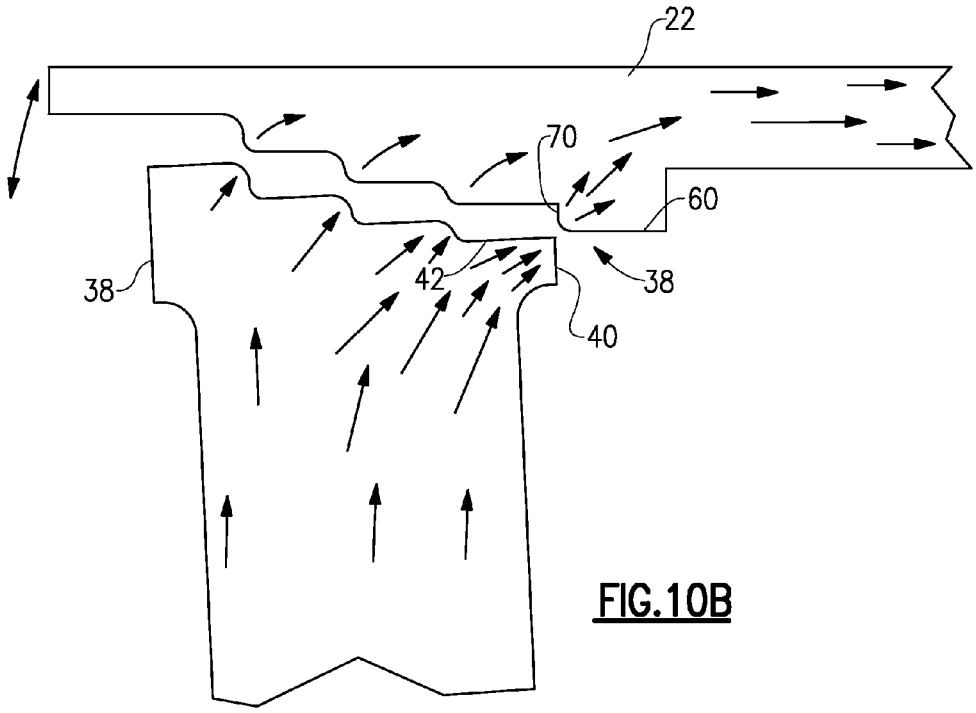
FIG. 10B is a schematic magnetic flux diagram for explaining the action of the core and armature of the relay of this invention.

The prior-art relay of FIG. 9A has a core pole face 18' that is flat to slightly crowned, and an armature 22' that is flat on its underside that faces the core pole face 18'. Consequently, there is a gap space of a full thirty six mils in this example when the armature is biased fully open, and this is also the gap space at initial energization of the coil or winding. The resulting flux path from the core and into the armature is shown with arrows. Because the initial magnetic flux is limited by the relay geometry, the closing force is relatively weak, and significant current is required to overcome the spring force and move the armature. This is to be contrasted with the geometry of the relay of this embodiment, as illustrated in FIG. 10B. Here, the travel between fully open and closed positions of the armature 22 is the same as with the relay of FIG. 10A, namely thirty-six mils, but due to the stair-step structure of the pole faces 18 and 38, there is a much smaller gap distance initially, thus increasing the amount of magnetic flux for a given number of ampere-turns in the relay coil. More specifically, the edge formed by surfaces 40 and 42 on the core pole face and the corresponding edge formed by surfaces 60 and 70 on armature pole face are positioned one above the other, and form a small magnetic gap. This creates an increased magnetic force initially when the coil 12 is energized. This creates enough force to overcome the force of the spring 30, so that the armature 22 moves towards closure.

Figure 11:
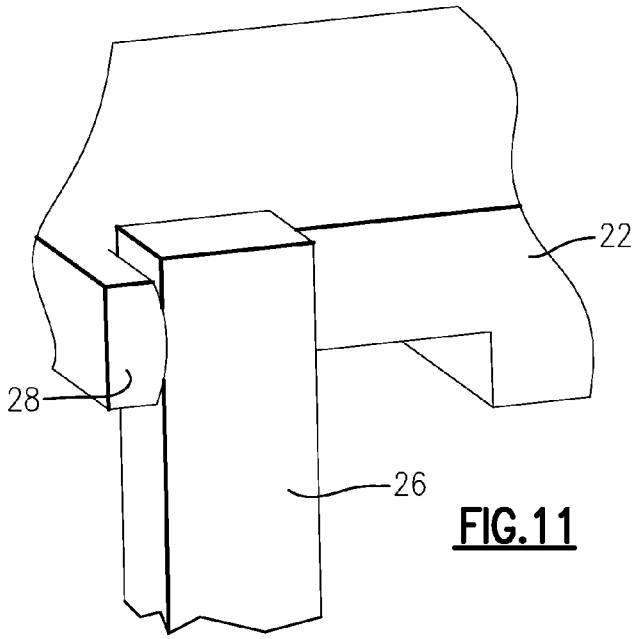
FIG. 11 is a partial perspective view featuring the armature bearing of this embodiment.

As illustrated in FIG. 11, the laterally extending hinge members 28 each have a forward or distal curved surface 80 that contacts a vertical flat surface of the corresponding yoke posts 26 of the armature bearing. When the armature 22 swings downward or upward, the center of motion of the armature 22 is displaced proximally or distally, creating a lateral (proximal-distal) "wipe" motion. This permits the vertical "riser" surfaces of the stair-step pole faces 18 and 38 to align with one another in succession, and then moves the corresponding vertical surface out of alignment to prevent the stair-steps from colliding with one another.

When the relay coil 12 is energized and the armature 22 begins to move, the action of the curved faces 80 of the hinge members 28 against the flat surfaces of the yoke posts 26 causes the armature 22 to move distally, in the direction towards the armature bearing 24. This moves the vertical surfaces 40 and 70 out of vertical alignment with one another so that they will not contact each other. At the same time, this brings the next set of corners, formed by the stair-step surfaces 50 and 44 and surfaces 62 and 72 vertically one above the other, which focuses the magnetic flux at the small gap formed between those two corners or edges. At the same time, the vertical surfaces or risers 40 and 70 face one another across a gap that is parallel to the axis of the core. The flux across that gap does not contribute to the acceleration of the armature 22. At each increment of movement of the armature towards is closed or no-gap position, the successive sets of edges or corners of the armature pole face 38 and the core pole face 18 align with one another to continue the controlled or managed concentration of magnetic flux. That is, as the armature moves towards the core, the successive corresponding edges of the stair-step structure are positioned so as to concentrate the magnetic flux as the relay closes.

Figure 12:
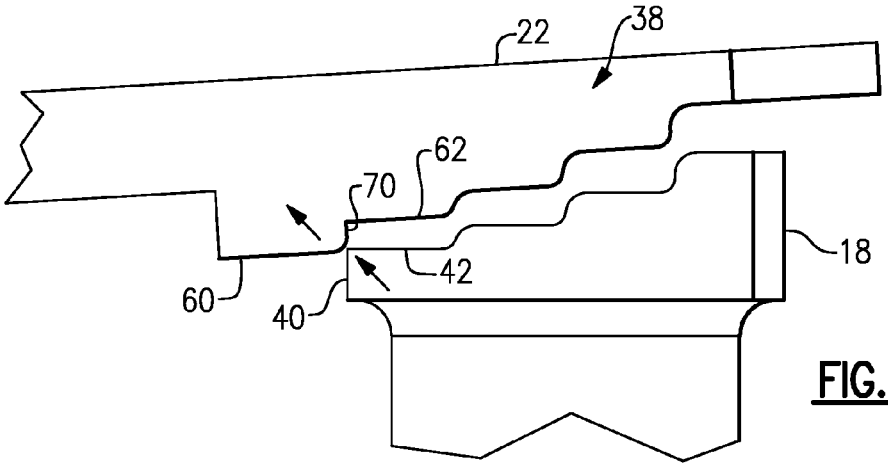
FIGS. 12, 13, and 14 are side views of the core and armature pole faces, showing the armature in an open or full-gap position, a partly-closed position, and a closed or no-gap position, respectively.
Figure 13:
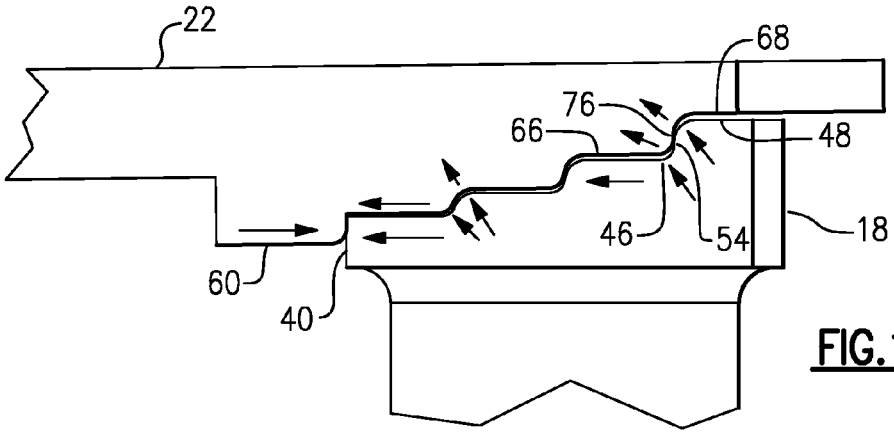
Figure 14:
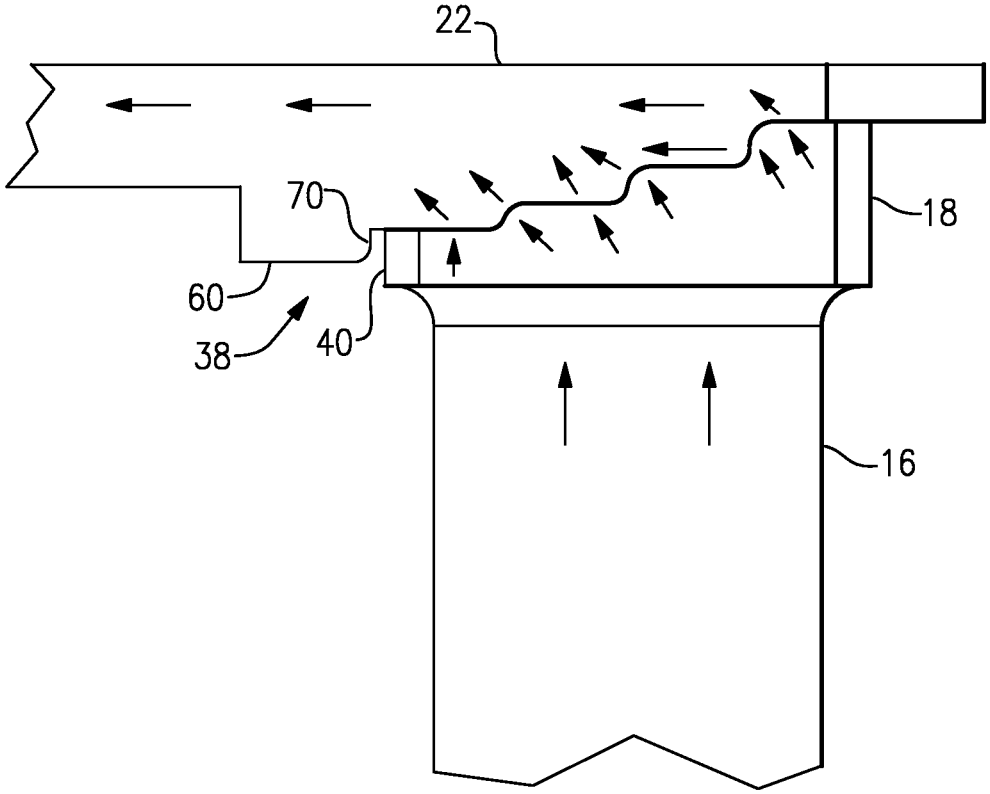

FIGS. 12, 13 and 14 illustrate the manner in which the stair-step configuration of the pole faces 18 and 38 manage the magnetic flux when current is applied to the relay coil. Initially, at full-gap or open position, the corners or edges formed by surfaces 40, 42 of the core face and surfaces 60,70 of the armature face create the smallest gap and thus the pathway for the magnetic flux lines, illustrated with arrow. As the armature moves through intermediate positions, the successive edges or corners align and create flux paths, as shown in FIG. 13. Finally, at full closure, the horizontal surfaces of the two pole faces 18 and 38 contact one another as shown in FIG. 14. The magnetic flux lines are again indicated with arrows in these views. As the armature moves downward towards the core, a significant part of the flux flows across the vertical gaps and reduces the net acceleration of the armature, as compared with the prior art structure of FIG. 10A. Also, as can be seen in FIGS. 12, 13 and 14, when the armature moves from the full gap to the closed position, the wipe action of the armature 22 creates vertical gaps between the opposing stair steps, e.g., gap between the surfaces 40 and 70, as the armature moves proximally (to the left in these views).

Figure 15:
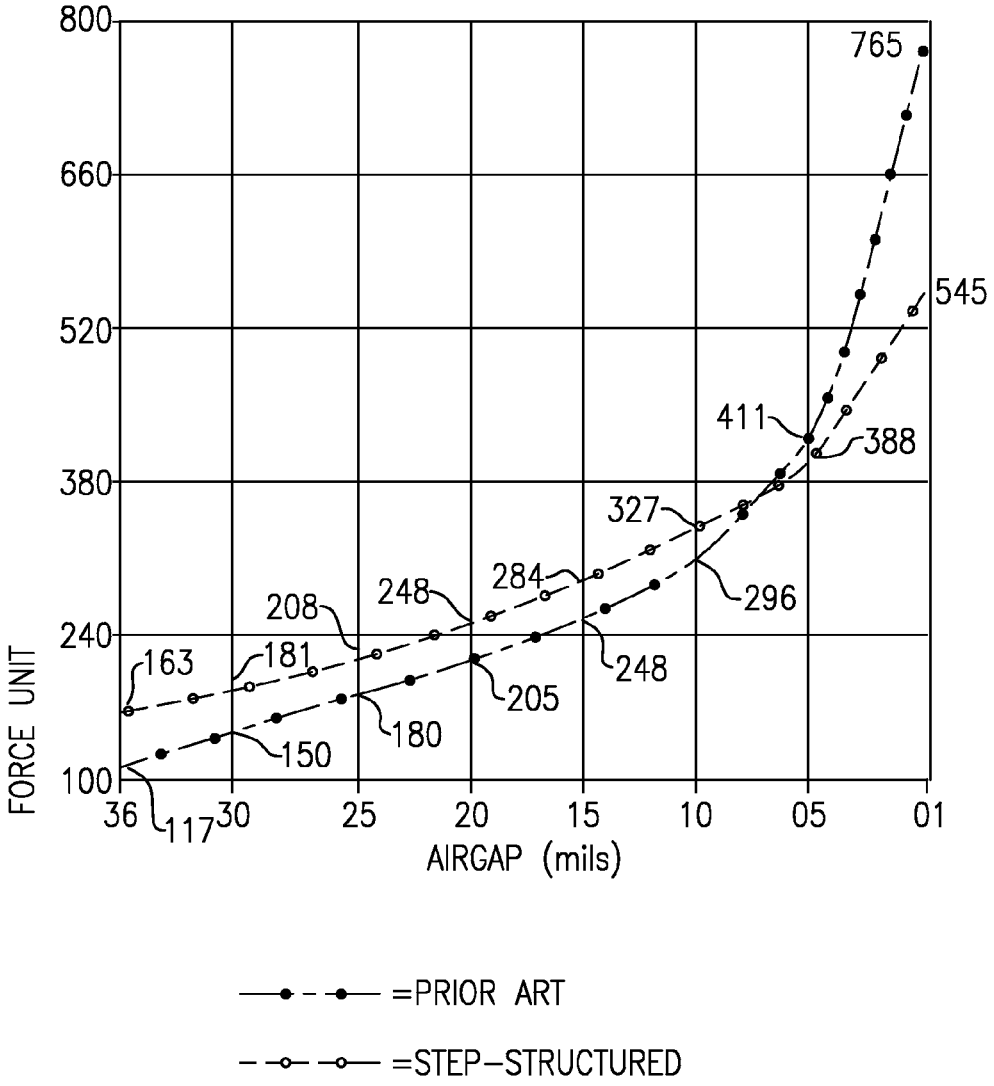
FIG. 15 is a force-gap chart showing respective curves of magnetic force versus gap width for the relay of this embodiment and for a comparative relay of standard core and armature construction according to the prior art.

A comparison of force-to-gap characteristics of the prior art relay (e.g., FIG. 10A) and of this embodiment is illustrated in the charts of FIG. 15, with the two relays being given identical coils, return springs, yokes and with the same initial gap (36 mils) between armature and core. The force on the armature is indicated in standardized units on the ordinate, with gap length in mils or thousandths of an inch given on the abscissa. The initial gap of 36 mils is indicated for the left extreme of each curve. The force-gap curve of the prior art or standard relay of FIG. 10A is shown in dash lines with solid dots, while the force-gap curve of the embodiment of this invention is shown in dash line with open dots.

Initially, for the same applied current and the same number of winding turns, the stair-step structure of the pole faces 18 and 38 of this embodiment creates a significantly greater magnetic force than does the relay of the prior art, to with, 163 units versus 117 units. This means a significantly smaller current would be required to overcome the spring force to start moving the armature. Stated otherwise, the armature 22 of the embodiments of this invention commences motion earlier than does the armature 22' of the prior art relay. The stair-step configuration of the pole faces 18 and 38 ensures that the magnetic flux is properly managed, that is, the magnetic force remains higher in the relay of this invention than in the prior art relay, until the armature has moved to near its closed position. As shown in FIG. 15, the force-gap curves cross one another when the gaps have diminished to about 7 mils. As the armatures continue to move to their closed position, i.e., with the gaps diminished to one mil, the magnetic force in the relay of this invention reaches 545 units, whereas the magnetic force in the prior art relay is a much higher 765 units. The comparatively reduced force on the armature 22 near full closure results in reduction or elimination of bounce and contact noise, and also reduces the mechanical slapping noise that characterizes the relays of the prior art. This is achieved without need for special pads or springs on the armature and core where they contact one another.

The relay of this invention is not to be limited only to the specific embodiment illustrated here. The core faces could have somewhat different geometry with different arrangements of zig-zag or stair-step pole faces, with more or fewer edges or corners, but designed to manage the magnetic flux so as to achieved the improved characteristics such as reduced noise and chatter, and better RF characteristics. The illustrated embodiment is a simple single-pole, double-throw relay with a single movable contact and a pair of fixed contacts, namely the usual NO and NC contacts. However, the principles of this invention can also be readily applied to multiple-pole relays, to specialized relays such as so-called contactors, and can be used in both AC and DC relays.

While the invention has been described with reference to a preferred embodiment, the invention is not limited only to that embodiment, but should be considered to cover many other possible variations thereof without departing from the scope and spirit of this invention, as defined in the appended claims.

We claim:

1. A relay comprising a yoke of a ferromagnetic material; a coil mounted on said yoke; a ferromagnetic core affixed onto said yoke and protruding through an axis of said coil; an armature formed of a ferromagnetic material having an armature bearing hinged onto said yoke, and said armature extending in a proximal-distal direction across the axis of the core, the armature being adapted to be pulled in to a closed position against said core when the coil is energized, a return spring mounted on said yoke and said armature and biased to pull the armature to an open position when the coil is de-energized; a movable contact mechanically affixed to said armature to move between open and closed positions; at least one fixed contact positioned to close electrically with said movable contact when the latter is in one of said open and closed positions; and the improvement wherein said core includes a core pole face at an axial end thereof in the form of a series of stepped flat strips that extend generally in respective generally horizontal planes that are substantially perpendicular to the axis of said core, and successive ones of which are joined by riser surfaces that extend from one said radial plane to the next thereof; and wherein said armature includes an armature pole face that is in the form of a corresponding series of stepped flat strips and riser surfaces the stepped flat strips and riser surfaces defining a succession of corner edges on the core pole face and armature pole face, respectively, and wherein said armature bearing is operative to cause said armature to travel in the proximal-distal direction as the armature moves from its open to its closed position to create a wipe motion, such that in the open position a first edge formed by a first riser surface and a first flat strip of the core pole face and first edge formed by a first riser surface and a first flat strip of the armature pole face are proximate to one another to form a first narrow gap therebetween to concentrate magnetic flux between the armature and the core at the first narrow gap, and as the armature moves from its open position towards its closed position, the transverse wipe motion of the armature causes the first edges to move away from one another and causes a second edge formed by a second riser surface and second flat strip of the core pole face and a second edge formed by a second riser surface and a second flat strip of the armature pole face to approach one another to create a second narrow gap to concentrate the magnetic flux lines between the armature and the core at the second narrow gap, and said wipe motion of the armature creates a vertical gap between the first vertical surface of the core pole face and the first vertical surface of the armature pole face, so that as the armature moves towards its closed position, a significant part of said flux flows across the vertical gap and reduces net acceleration of the armature; to provide thereby an increased initial closing force on the armature when the armature is at its open position and to limit the closing force as the armature moves to its closed position.

2. Relay according to claim 1, wherein a portion of said core pole face extends laterally beyond said core pole in the direction towards said armature bearing.

3. Relay according to claim 1, wherein the axial height of the stepped flat strips of the core pole face increases in the direction away from the armature bearing.

4. A relay comprising a yoke of a ferromagnetic material; a coil mounted on said yoke; a ferromagnetic core affixed onto said yoke and protruding through an axis of said coil; an armature formed of a ferromagnetic material having an armature bearing hinged onto said yoke, and the armature extending across the axis of the core, the armature being adapted to be pulled in to a closed position against said core when the coil is energized, a return spring mounted on said yoke and said armature and biased to pull the armature to an open position when the coil is de-energized; a movable contact mechanically affixed to said armature to move between open and closed positions; at least one fixed contact positioned to close electrically with said movable contact when the latter is in one of said open and closed positions; and the improvement wherein said core includes a core pole face at an axial end thereof in the form of a series of stepped flat strips that extend generally in respective generally radial planes that are substantially perpendicular to the axis of the core and successive ones of which are joined by riser surfaces that extend from one said radial plane to the next thereof; and wherein said armature includes an armature pole face that is in the form of a corresponding series of stepped flat strips and riser surfaces, wherein the armature pole face has a flat strip that protrudes axially below an end of the core pole face on a side thereof towards the armature bearing.

5. Relay according to claim 1, wherein said return spring includes a leaf spring of omega profile having one leg affixed to said armature, one leg affixed to said yoke and a generally arcuate portion therebetween arching over said armature bearing.

6. Relay according to claim 1, wherein said armature bearing is composed of a pair of transverse hinge members extending laterally from a proximal end of said armature, and a pair of hinge posts on said yoke, such that the hinge members fit against said hinge posts of said yoke to form the armature bearing, and wherein said hinge members each have an arcuate surface facing the respective hinge posts and oriented in the proximal-distal direction of the armature, such that as said armature closes it also travels longitudinally in said proximal-distal direction to create a wipe motion.

7. A relay comprising a yoke of a ferromagnetic material; a coil mounted on said yoke; a ferromagnetic core affixed onto said yoke and protruding through an axis of said coil; an armature formed of a ferromagnetic material having an armature bearing hinged onto said yoke, the armature extending in a proximal-distal direction from said armature bearing across the axis of the core, the armature being adapted to swing on said armature bearing and be pulled in to a closed position against said core when the coil is energized, a return spring mounted on said yoke and said armature and biased to pull the armature to an open position when the coil is de-energized; a movable contact mechanically affixed to said armature to move between open and closed positions; at least one fixed contact positioned to close electrically with said movable contact when the latter is in one of said open and closed positions; and the improvement wherein said core and said armature have corresponding respective pole faces having mating zig-zag profiles, when viewed across an axis of the armature bearing that is along the proximal-distal direction of said armature, said profiles having stepped successive transverse surfaces that are substantially parallel to the axis of the core, and axial riser surfaces, that are substantially perpendicular to the axis of the core, that meet at corners, said armature bearing imposing upon said armature a wipe motion in its proximal-distal direction as the armature moves from its open to its closed position, and the respective corners being oriented, such that when the armature is in its open position a first pair of corresponding corners of the armature pole face and the core pole face are aligned in proximity to one another to define a first air gap at which magnetic flux is concentrated; and as the armature moves from its open position to its closed position the wipe motion of the armature moves the first pair of corresponding corners out of alignment with one another, and causes a second corner of the armature pole face to move into alignment with a corresponding second corner of the core pole face to define a second air gap at which the magnetic flux is concentrated, and as the armature continues to move to its closed position the magnetic flux between the core pole face and armature pole face is concentrated at successive corresponding corners of the mating zig-zag profiles; whereby the concentration of magnetic flux provides an increased initial force on the armature when the armature is at the open position and limits closing force on the armature as the armature moves to its closed position.

8. Relay according to claim 7, wherein said armature is in the form of a plate of a ferromagnetic material having a proximal end at which are formed transverse hinge members that fit against hinge posts of said yoke to form the armature bearing, and a distal end; and a series of steps that extend transversely across said plate to constitute said armature pole face.

9. Relay according to claim 8, wherein when said series of steps are of progressively reduced thickness in the proximal-distal direction from a proximal side of each of the pole faces to a distal side thereof.

10. Relay according to of claim 9, wherein said steps end at radiused edges.

11. Relay according to claim 7, wherein said hinge members have an arcuate surface facing the respective hinge posts and oriented in said proximal distal direction, so that as said armature closes it also travels laterally to create said wipe motion.

12. Relay according to claim 11, wherein said wipe motion allows respective corners of the pole face and of the armature pole face to be substantially aligned to focus magnetic flux, but to keep transverse surfaces of the armature pole face and the core pole face from colliding with one another when the armature is drawn to its closed position.

13. Relay according to claim 4, wherein said armature bearing is composed of a pair of transverse hinge members extending laterally from a proximal end of said armature, and a pair of hinge posts on said yoke, such that the hinge members fit against said hinge posts of said yoke to form the armature bearing, and wherein said hinge members each have an arcuate surface facing the respective hinge posts and oriented in the proximal-distal direction of the armature, such that as said armature closes it also travels longitudinally in said proximal-distal direction to create a wipe motion.

14. Relay according to claim 4, wherein said return spring includes a leaf spring of omega profile having one leg affixed to said armature, one leg affixed to said yoke and a generally arcuate portion therebetween arching over said armature bearing.

* * * * *